United States Patent [19]

Winthaegen et al.

[11] 4,086,008

[45] Apr. 25, 1978

[54] ELECTROPHOTOGRAPHIC COPYING APPARATUS WITH DEVICE FOR EXPOSING IMAGED PHOTOCONDUCTIVE PLATE

[75] Inventors: Leon M. W. Winthaegen, Maasbree; Mathias J. J. M. Vola, Sittard, both of Netherlands

[73] Assignee: Océ-van der Grinten, N.V., Venlo, Netherlands

[21] Appl. No.: 738,906

[22] Filed: Nov. 4, 1976

[51] Int. Cl.[2] ..... G03G 15/00

[52] U.S. Cl. ..... 355/7; 355/71

[58] Field of Search ..... 355/7, 16, 3 R, 125, 355/71; 96/44

[56] References Cited

U.S. PATENT DOCUMENTS 3,724,942 4/1973 Gibson et al. ..... 355/71 X

OTHER PUBLICATIONS

"Shutter Assembly for Selectively Erasing Nonimage Areas of a Photoconductor Segment", IBM Tech. Bull., vol. 16, No. 4, Sept. 1973, pp. 1262, 1263.

*Primary Examiner*—Richard L. Moses

*Attorney, Agent, or Firm*—Albert C. Johnston

[57] ABSTRACT

In an electrophotographic copying apparatus in which an imagewise exposed photoconductive plate moving to a developing station passes a light source and a light shield which are arranged for selectively exposing parts of the photoconductive plate outside the area of the copy image, the light shield is made slightly light transmitting, such as by making it of a glass or plastic having a light transmittance of 2.5 to 25%, so that the light source and shield serve the dual functions of fully exposing nonimage parts of the plate and weakly exposing its image area, thus improving the contrast and tone reproduction in the developed image.

3 Claims, 1 Drawing Figure

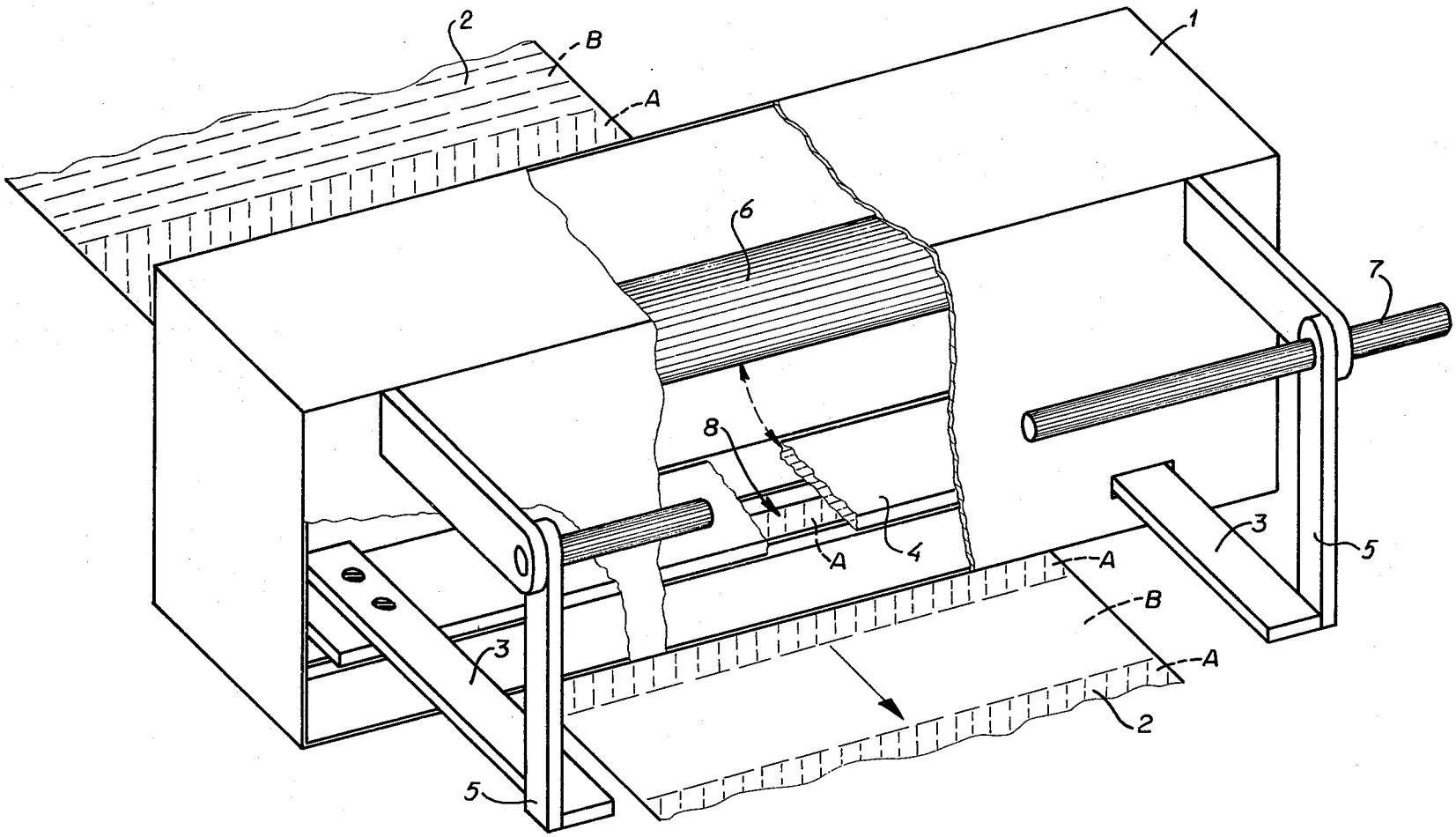
1
2
3
4
5
6
7
8
A
B

ELECTROPHOTOGRAPHIC COPYING APPARATUS WITH DEVICE FOR EXPOSING IMAGED PHOTOCONDUCTIVE PLATE

This invention relates to an electrophotographic copying apparatus provided with an exposure device of a kind which comprises a light source and a movable shield and extends across the direction of movement of the photoconductive image plate of the apparatus, which exposure device serves for selectively exposing parts of the image plate that are not included in the copy formation, before this image plate is developed.

Exposure devices of this kind are used successfully for removing electrostatic charges from those parts of the image plate which are not imagewise exposed during the copying. In this way, it is possible to prevent undesired stripes or edges from forming about the copy image during the development of the image plate. The formation of such stripes or edges would not only make the copies produced unattractive but would also involve an unnecessary consumption of developing material; and in cases of the image being transferred onto a copy sheet of identical size, developing material would be present outside the area of the copy sheet and consequently would pollute the transfer device.

A desirable embodiment of the stated kind of exposure device is described in IBM Technical Disclosure Bulletin Vol. 16, No. 4, September 1973. In that device, the movable shield is designed as an elongate, light impervious shutter plate which is mounted on swivel arms upon which it can be brought into different positions between the light source and the image plate.

It is known that the tone reproduction of an electrophotographic copying system can be improved considerably by subjecting the parts of the photoconductive image plate which are used for the copy formation not only to an imagewise exposure but also to a weak uniform exposure. See, for instance, German patent application 1,943,502 and Dutch patent application 72,12,331, laid open for public inspection. In practice this weak uniform exposure is effected by a tubular lamp extending transverse to the direction of movement of the image plate.

The object of the present invention is to provide an exposure device of the kind above mentioned by which both a selective exposure of non-image parts and a contrast-improving uniform exposure can be effected.

It has been found that this object can be achieved by making the movable shield of an exposure device of the kind above mentioned slightly light-transmitting, i.e., slightly pervious to the light from the light source. In this way it is brought about that the shield even in its screening position transmits over its whole surface a small quantity of the light emitted by the light source, so that the contrast improving exposure is realized without need for either special control means or a special light source.

The required slight light transmission can be obtained when the shield is made of light impervious material, as is the case with the above mentioned shutter plate, by providing a narrow slotted opening in the shield. It is more advantageous and desirable, however, to have the shield made of slightly light-transparent material. The known, partially light-absorbing kinds of tinted or untinted glass and plastics are materials suitable for this purpose.

The degree of light transmittance required in any given case in order to obtain the desired result depends of course upon the exposure characteristic of the image plate employed and the developing characteristic of the image dvveloping system. It has been observed, however, that in the use of image plates of the usual kind beneficial results are obtained when the shield has a light transmittance of 2.5 to 25%.

The accompanying drawing schematically illustrates a region of an electrophotographic copying apparatus embodying an exposure device according to the present invention.

A photoconductive plate 2 bearing an electrostatic image *a* formed on it by imagewise exposure of an original is moved toward an image developing station, in the direction indicated by the arrow. A light shield having the form of a shutter plate 4 mounted on swivel arms 5 is disposed between the image plate 2 and a light source 6, in a position such that the shield or shutter plate 4 will overlie a slot 8 formed in the bottom of the light box 1 and thus will obstruct the passage of light from the lamp 6 through the slot 8 to the portion of the exposed area A moving beneath the slot. The swivel arms 5 are attached to a shaft 7, and the shield 4 is fixed to strips 3 which extend into the box 1 from the lower ends of the arms 5.

Whenever a non-image area B of the plate 2 is about to reach the location of the slot 8, the shaft 7 is turned to move the shutter plate 4 away from the slot, as indicated by the arrow shown in broken lines. In that position of the shutter plate, light from the source 6 will pass with full intensity to a non-image area B of the image plate outside the imagewise exposed area thereof.

The shield 4, however, is made of a slightly transparent material, for instance of a tinted plastics known as Opal 060 (from ICI), so as to have a light transmittance of about 8%. When the shield is in the position over the shaft 8, this limited light transmittance brings about a weak uniform exposure of the image area of the photoconductive plate 2, which is sufficient to subdue residual charges in exposed parts of the image area and thus to improve considerably the contrast and tone reproduction in the image formed on the plate 2 at the developing station.

What is claimed is:

1. In an electrophotographic copying apparatus in which a photoconductive plate bearing a latent image is movable in a path to a station for developing the image and an exposure device comprising a light source and a movable light shield disposed over said path, said shield normally lying in a position to obstruct passage of light from said source to said plate and being displaceable away from said position for selectively exposing to such light areas of said plate outside the area of said image, the improvement wherein said light shield is made slightly light transmitting to effect a weak uniform exposure of the image area of said plate when said shield is in said position.

2. Apparatus according to claim 1, said shield being composed of slightly light transmitting material.

3. Apparatus according to claim 1, said shield being composed of slightly light transmitting material giving it a light transmittance of 2.5 to 25%.

* * * * *